US011508538B1

(12) United States Patent
Kao

(10) Patent No.: US 11,508,538 B1
(45) Date of Patent: Nov. 22, 2022

(54) INSULATION DEVICE AND LOAD BREAK FUSE CUTOUT ASSEMBLY HAVING THE SAME

(71) Applicant: GOODWELL ELECTRIC CORPORATION, Taipei (TW)

(72) Inventor: Sui-Chan Kao, Taipei (TW)

(73) Assignee: GOODWELL ELECTRIC CORPORATION, Taipei (TW)

( * ) Notice: Subject to any disclaimer, the term of this patent is extended or adjusted under 35 U.S.C. 154(b) by 0 days.

(21) Appl. No.: 17/540,409

(22) Filed: Dec. 2, 2021

(30) Foreign Application Priority Data

Nov. 17, 2021 (TW) ..... 110142680

(51) Int. Cl.
*H01H 31/12* (2006.01)
*H01H 85/38* (2006.01)

(52) U.S. Cl.
CPC ..... *H01H 31/127* (2013.01); *H01H 85/38* (2013.01); *H01H 2085/381* (2013.01); *H01H 2085/383* (2013.01)

(58) Field of Classification Search
CPC .. H01H 31/127; H01H 85/0241; H01H 85/08; H01H 85/175; H01H 85/2045; H01H 85/303; H01H 85/38; H01H 85/43; H01H 2085/0291; H01H 2085/381; H01H 2085/383
See application file for complete search history.

(56) References Cited

U.S. PATENT DOCUMENTS

2002/0158745 A1* 10/2002 Haynam ..... H01H 31/023 337/171
2007/0293073 A1* 12/2007 Hughes ..... H01H 33/66207 439/186
2009/0322463 A1* 12/2009 Van Heerden ..... H01H 85/28 337/237
2010/0230263 A1* 9/2010 Haj-Maharsi ..... H01H 31/127 200/48 R
2011/0094342 A1* 4/2011 Creech ..... H01H 31/127 81/3.8
2012/0055695 A1* 3/2012 Zhang ..... C08J 5/244 174/138 C
2016/0013004 A1* 1/2016 Kester ..... H01H 85/2045 337/202
2016/0240336 A1* 8/2016 Weng ..... H01H 31/12
2017/0059640 A1* 3/2017 Haensgen ..... H01H 9/167

* cited by examiner

*Primary Examiner* — Jacob R Crum

(57) ABSTRACT

An insulation device is disclosed. The insulation device is allowed to be assembled with a fuse tube device so as to form a load break fuse cutout fully closed. The insulation device comprises: a full-closed cylindrical insulator oriented vertically, a first cylindrical insulator oriented horizontally, a second cylindrical insulator oriented horizontally, a third cylindrical insulator oriented horizontally, a first electrical connection unit accommodated in the first cylindrical insulator, a second electrical connection unit accommodated in the second cylindrical insulator, a first arc extinguishing unit accommodated in the first cylindrical insulator, a second arc extinguishing unit accommodated in the second cylindrical insulator, and a mounting bracket connected to the full-closed cylindrical insulator. The full-closed cylindrical insulator, the first cylindrical insulator, the second cylindrical insulator, and the third cylindrical insulator are made integratedly so as to form a main insulation body of the insulation device.

20 Claims, 9 Drawing Sheets

INSULATION DEVICE AND LOAD BREAK FUSE CUTOUT ASSEMBLY HAVING THE SAME

BACKGROUND OF THE INVENTION

1. Field of the Invention

The present invention relates to the technology field of fuse cutout, and more particularly to an insulation device and a load break fuse cutout assembly having the insulation device.

2. Description of the Prior Art

With reference to FIG. 1, there is shown a side view of a conventional load break fuse cutout. Moreover, FIG. 2 shows a stereo diagram of the conventional load break fuse cutout. According to FIG. 1 and FIG. 2, the conventional load break fuse cutout 1*a* comprises: an insulator 11*a*, a fuse tube 12*a*, a first fixing unit 13*a*, a first conductor connecting unit 14*a*, a conductive plate spring 10*a*, a second fixing unit 15*a*, a second conductor connecting unit 16*a*, a toggle mechanism 17*a*, and a mounting bracket 18*a*, wherein there is a fuse element disposed in the fuse tube 12*a*.

As FIG. 1 shows, a first conductor coupled to a power source is connected to the first conductor connecting unit 14*a*, and a second conductor coupled to a load terminal is connected to the second conductor connecting unit 16*a*. Therefore, electric power is transmitted from the first conductor to the fixing unit 13*a* and the conductive plate spring 10*a* via the first conductor connecting unit 14*a*, and is further transmitted to a first electrical connecting element 121*a* disposed on the top of the fuse tube 12*a*. Furthermore, the first electrical connecting element 121*a* transmits the electric power to the fuse element, such that the electric power is further transmitted from the fuse element to a second electrical connecting element 124*a* disposed on the bottom of the fuse tube 12*a*, and is eventually transmitted to the load terminal via the second conductor connecting unit 16*a* and the second conductor.

It is well known that, in case of a power system being in a condition of abnormal overload or short-circuit, overcurrent causes the fuse element (also called fuse link) in the fuse tube 12*a* to melt. In such case, electric arc immediately takes place in the fuse tube 12*a*, thereby heating arc-extinguishing elements in the fuse tube 12*a* so as to explode a lot of gas. After that, high pressure is produced in the fuse tube 12*a*, leading the electric arc to be blew off in the fuse tube 12*a*. As described in more detail below, melting of the fuse element causes the contact between the first electrical connecting element 121*a* and the conductive plate spring 10*a* be not tightened like before, therefore the fuse tube 12*a* drops out due to the action of the toggle mechanism 17*a* (as FIG. 2 shows). In such case, the load break fuse cutout 1*a* is in an open position, such that the overcurrent is prevented from flowing into the load terminal via the second conductor connecting unit 16*a*.

It is worth mentioning that, during the normal operation of the load break fuse cutout 1*a*, an engineering staff is allowed to operate a load break tool to connect a pull ring 123*a* and/or a pull hook 122*a* of the fuse tube 12*a*, and then to directly pull the fuse tube 12*a* to drop out. As described in more detail below, an upper cover is adopted for shielding the first fixing unit 13*a*, the first conductor connecting unit 14*a*, the conductive plate spring 10*a*, and the first electrical connecting element 121*a*, and a lower cover is adopted for shielding the second conductor connecting unit 16*a*, the toggle mechanism 17*a*, and the second electrical connecting element 124*a*. The upper cover and the lower cover protect birds, kites, and branches from electrocution, which may also trigger an over-current condition that causes a power outage.

Generally, the load break fuse cutout 1*a* is applied in an electric power system, and is used in primary overhead feeder lines and taps to protect distribution transformers from current surges and overloads. According to experiences, the load break fuse cutout 1*a* shows many drawbacks in practical use. The drawbacks are summarized as follows.

(1) the upper cover and the lower cover both have a semi-closed housing, and that means there is still a chance for birds, kites, and/or branches to cause electrocution by touching the conductive articles covered by the upper cover and/or the lower cover.

(2) Because being covered by the upper cover, it is hard for the engineering staff to control a load break tool to connect a pull ring 123*a* and/or a pull hook 122*a* of the fuse tube 12*a*. Moreover, it is worth mentioning that, during using the load break tool to directly pull the fuse tube 12*a* to drop out (as FIG. 2 shows), electric arc is produced between the conductive plate spring 10*a* and the first electrical connecting element 121*a*.

(3) Because the fuse tube 12*a* is assembled with the insulator 11*a* through the toggle mechanism 17*a*, it is impossible for the engineering staff staying on the ground to control the load break tool or a specially-designed tool to replace the fuse tube 12*a* of the load break fuse cutout 1*a* by a new one.

From the above descriptions, it is understood that there is room for improvement in the conventional the load break fuse cutout. In view of that, the inventor of the present application has made great efforts to make inventive research and eventually provided an insulation device and a load break fuse cutout assembly having the insulation device.

SUMMARY OF THE INVENTION

The primary objective of the present invention is to disclose an insulation device, which is allowed to be assembled with a fuse tube device so as to form a load break fuse cutout fully closed.

For achieving the primary objective mentioned above, the present invention provides an embodiment of the insulation device, comprising;

- a full-closed cylindrical insulator oriented vertically;
- a first cylindrical insulator oriented horizontally and having a first end and a second end, wherein the first end is connected to the full-closed cylindrical insulator, the second end having a first terminal connecting opening, and a first cable connection opening being formed on one side of the first cylindrical insulator;
- a second cylindrical insulator oriented horizontally and having a third end and a fourth end, wherein the third end is connected to the full-closed cylindrical insulator, the fourth end having a second terminal connecting opening, and a second cable connection opening being formed on one side of the second cylindrical insulator;
- a third cylindrical insulator oriented horizontally and having a fifth end and a six end, wherein the fifth end is connected to the full-closed cylindrical insulator so as to be positioned at a position on a center segment of the full-closed cylindrical insulator, and the sixth end having a first opening;

a first electrical connection unit, being accommodated in the first cylindrical insulator, and having a first cable connecting member that is positioned in the first cable connection opening, such that a first electrical cable is allowed to be connected to the first cable connecting member via the first cable connection opening;

a second electrical connection unit, being accommodated in the second cylindrical insulator, and having a second cable connecting member that is positioned in the second cable connection opening, such that a second electrical cable is allowed to be connected to the second cable connecting member via the second cable connection opening;

a first arc extinguishing unit, being accommodated in the first cylindrical insulator, and comprising a first arc extinguishing tube and a first conductive member having a first top terminal and a first tail terminal, wherein a portion of the first arc extinguishing tube is positioned in the first terminal connecting opening, the first top terminal being positioned in the first arc extinguishing tube, and the first tail terminal contacting the first electrical connection unit;

a second arc extinguishing unit, being accommodated in the second cylindrical insulator, and comprising a second arc extinguishing tube and a second conductive member having a second top terminal and a second tail terminal, wherein a portion of the second arc extinguishing tube is positioned in the second terminal connecting opening, the second top terminal being positioned in the second arc extinguishing tube, and the second tail terminal contacting the second electrical connection unit; and a mounting bracket, comprising a supporting member and a mounting member, wherein the supporting member is embedded in the first opening, and the mounting member being connected with the supporting member and exposed out of the third cylindrical insulator.

Moreover, the present invention also provides an embodiment of a load break fuse cutout assembly fully closed, comprising;

a fuse tube device, comprising an insulation housing and a fuse tube accommodated in the insulation housing; wherein the fuse tube has a first terminal and a second terminal both protruding out of the insulation housing, a first arc extinguishing member being disposed on a top of the first terminal, and a second arc extinguishing member being disposed on a top of the second terminal; and an insulation device, comprising:

a full-closed cylindrical insulator oriented vertically;

a first cylindrical insulator oriented horizontally and having a first end and a second end, wherein the first end is connected to the full-closed cylindrical insulator, the second end having a first terminal connecting opening, and a first cable connection opening being formed on one side of the first cylindrical insulator;

a second cylindrical insulator oriented horizontally and having a third end and a fourth end, wherein the third end is connected to the full-closed cylindrical insulator, the fourth end having a second terminal connecting opening, and a second cable connection opening being formed on one side of the second cylindrical insulator;

a third cylindrical insulator oriented horizontally and having a fifth end and a six end, wherein the fifth end is connected to the full-closed cylindrical insulator so as to be positioned at a position on a center segment of the full-closed cylindrical insulator, and the sixth end having a first opening;

a first electrical connection unit, being accommodated in the first cylindrical insulator, and having a first cable connecting member that is positioned in the first cable connection opening, such that a first electrical cable is allowed to be connected to the first cable connecting member via the first cable connection opening;

a second electrical connection unit, being accommodated in the second cylindrical insulator, and having a second cable connecting member that is positioned in the second cable connection opening, such that a second electrical cable is allowed to be connected to the second cable connecting member via the second cable connection opening;

a first arc extinguishing unit, being accommodated in the first cylindrical insulator, and comprising a first arc extinguishing tube and a first conductive member having a first top terminal and a first tail terminal, wherein a portion of the first arc extinguishing tube is positioned in the first terminal connecting opening, the first top terminal being positioned in the first arc extinguishing tube, and the first tail terminal contacting the first electrical connection unit;

a second arc extinguishing unit, being accommodated in the second cylindrical insulator, and comprising a second arc extinguishing tube and a second conductive member having a second top terminal and a second tail terminal, wherein a portion of the second arc extinguishing tube is positioned in the second terminal connecting opening, the second top terminal being positioned in the second arc extinguishing tube, and the second tail terminal contacting the second electrical connection unit; and a mounting bracket, comprising a supporting member and a mounting member, wherein the supporting member is embedded in the first opening, and the mounting member being connected with the supporting member and exposed out of the third cylindrical insulator;

wherein when assembling the insulation device with the fuse tube device, the first arc extinguishing member and the first terminal being inserted in to the first terminal connecting opening of the first cylindrical insulator, such that the first terminal contacts the first conductive member so as to be electrically coupled to the first electrical connection unit through the first conductive member, and the first arc extinguishing member being positioned in the first arc extinguishing tube;

wherein when assembling the insulation device with the fuse tube device, the second arc extinguishing member and the second terminal being inserted in to the second terminal connecting opening of the second cylindrical insulator, such that the second terminal contacts the second conductive member so as to be electrically coupled to the second electrical connection unit through the second conductive member, and the second arc extinguishing member being positioned in the second arc extinguishing tube.

In one embodiment, the full-closed cylindrical insulator, the first cylindrical insulator, the second cylindrical insulator, and the third cylindrical insulator are made integratedly so as to form a main insulation body of the insulation device.

In one embodiment, the full-closed cylindrical insulator is formed with a plurality of first weathersheds thereon, the first cylindrical insulator is formed with a plurality of second weathersheds thereon, the second cylindrical insulator is formed with a plurality of third weathersheds thereon, and the third cylindrical insulator is formed with a plurality of fourth weathersheds thereon.

In one embodiment, the insulation device further comprises a structural unit accommodated in the main insulation body, wherein the structural unit comprises:

a first structural member, being disposed in the full-closed cylindrical insulator, and having a first part extending into the first cylindrical insulator;

a second structural member, being disposed in the full-closed cylindrical insulator, and having a second part extending into the second cylindrical insulator;

a third structural member, being disposed in the center segment of the full-closed cylindrical insulator, and being connected with the supporting member of the mounting bracket; and a connecting member, being disposed in the full-closed cylindrical insulator, and being assembled with the first structural member, the second structural member and the third structural member so as to form said structural unit.

In one embodiment, the first arc extinguishing unit further comprises a first tube, wherein two ends of the first tube have a second opening and a third opening, respectively, and the first part of the first structural member is positioned in the third opening;

wherein the first conductive member is disposed in the first tube, and the first top terminal of the first conductive member has a first connection opening for receiving the first part, and the first tail terminal of the first conductive member has a first claw-type opening;

wherein the first arc extinguishing tube is disposed in the first tube, and two ends of the first arc extinguishing tube have a second connection opening and a third connection opening, respectively; and wherein the second connection opening and the third connection opening communicate with a first arc extinguishing chamber in the first arc extinguishing tube, and the first claw-type opening is positioned in the first arc extinguishing tube via the second connection opening.

In one embodiment, the second arc extinguishing unit further comprises a second tube, wherein two ends of the second tube have a fourth opening and a fifth opening, respectively, and the second part of the second structural member is positioned in the fifth opening;

wherein the second conductive member is disposed in the second tube, and the second top terminal of the second conductive member has a fourth connection opening for receiving the second part, and the second tail terminal of the second conductive member has a second claw-type opening;

wherein the second arc extinguishing tube is disposed in the second tube, and two ends of the second arc extinguishing tube have a fifth connection opening and a sixth connection opening, respectively; and wherein the fifth connection opening and the sixth connection opening communicate with a second arc extinguishing chamber in the second arc extinguishing tube, and the second claw-type opening is positioned in the second arc extinguishing tube via the fifth connection opening.

In one embodiment, the first electrical connection unit further has a first collar member for receiving the first part of the first structural member. Moreover, the first collar member and the first cable connecting member are made integratedly so as to form said first electrical connection unit.

In one embodiment, the second electrical connection unit further has a second collar member for receiving the second part of the second structural member. Moreover, the second collar member and the second cable connecting member are made integratedly so as to form said second electrical connection unit.

BRIEF DESCRIPTION OF THE DRAWINGS

The invention, as well as a preferred mode of use and advantages thereof, will be best understood by referring to the following detailed description of an illustrative embodiment in conjunction with the accompanying drawings, wherein.

DETAILED DESCRIPTION OF THE PREFERRED EMBODIMENTS

To more clearly describe an insulation device and a load break fuse cutout assembly having the insulation device disclosed by the present invention, embodiments of the present invention will be described in detail with reference to the attached drawings hereinafter.

Insulation Device

Figure 1:
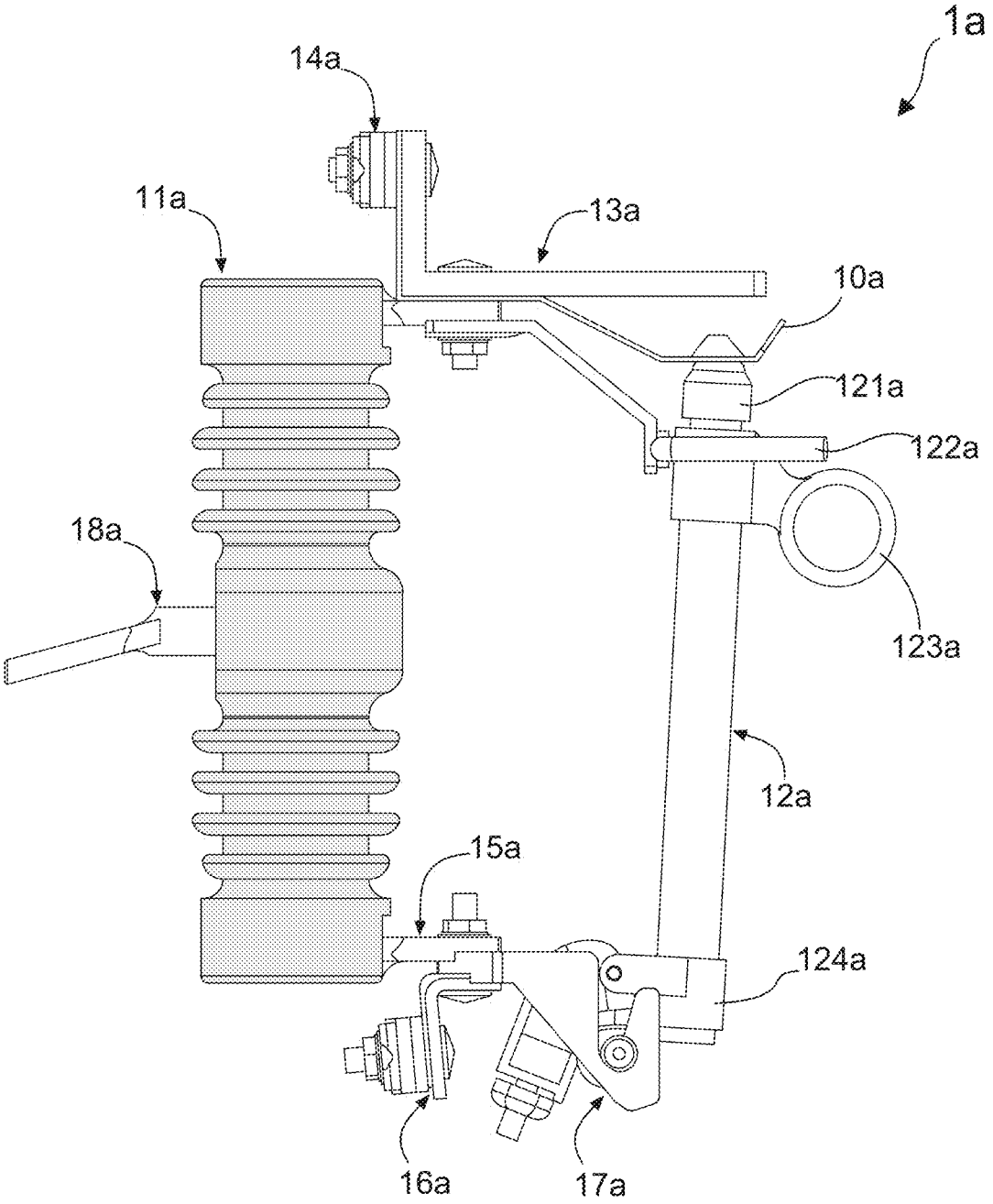
FIG. 1 (Prior art)
FIG. 1 shows a side view of a conventional load break fuse cutout.
Figure 2:
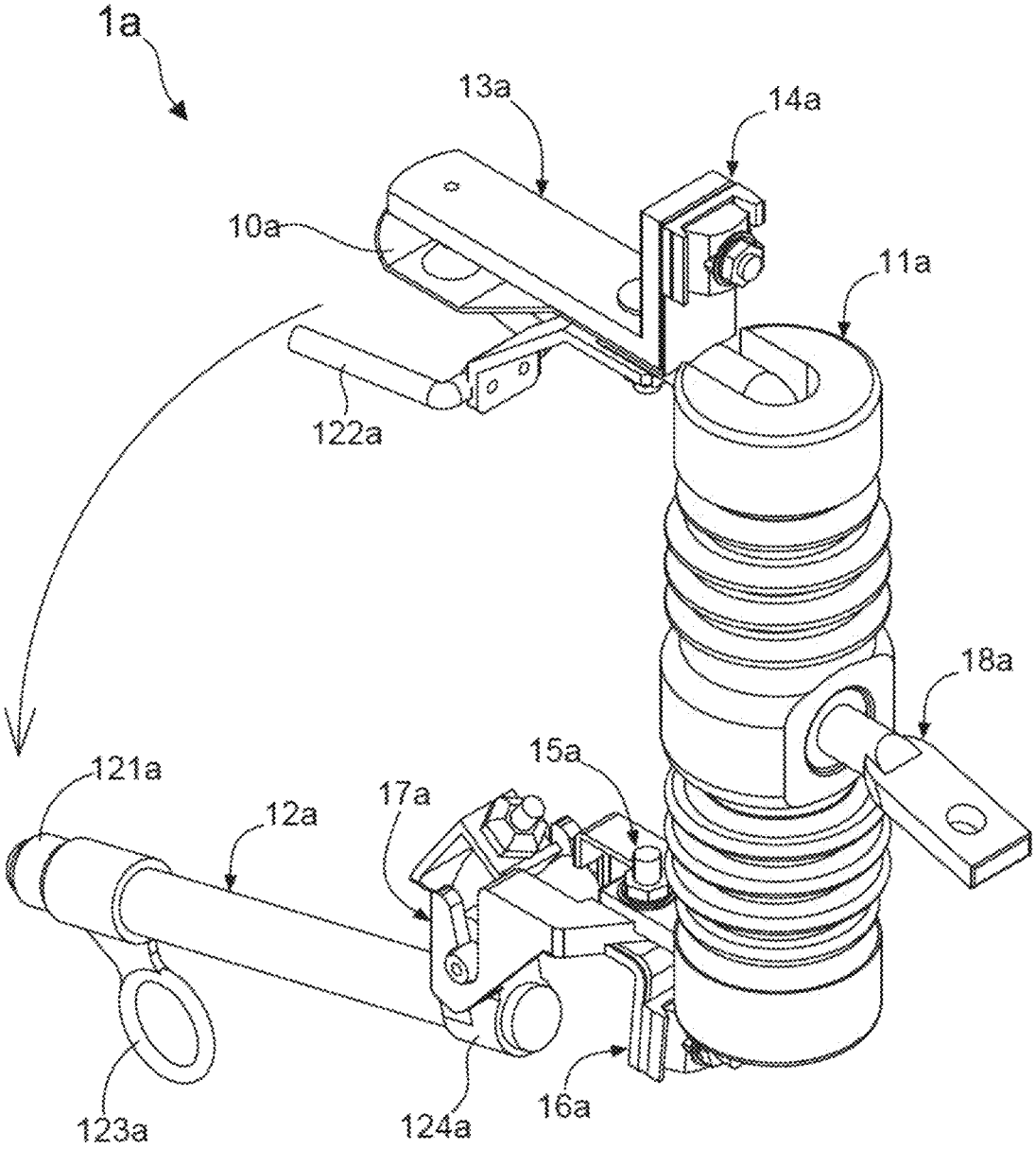
FIG. 2 (Prior art)
FIG. 2 shows a stereo diagram of the conventional load break fuse cutout.
Figure 3A:
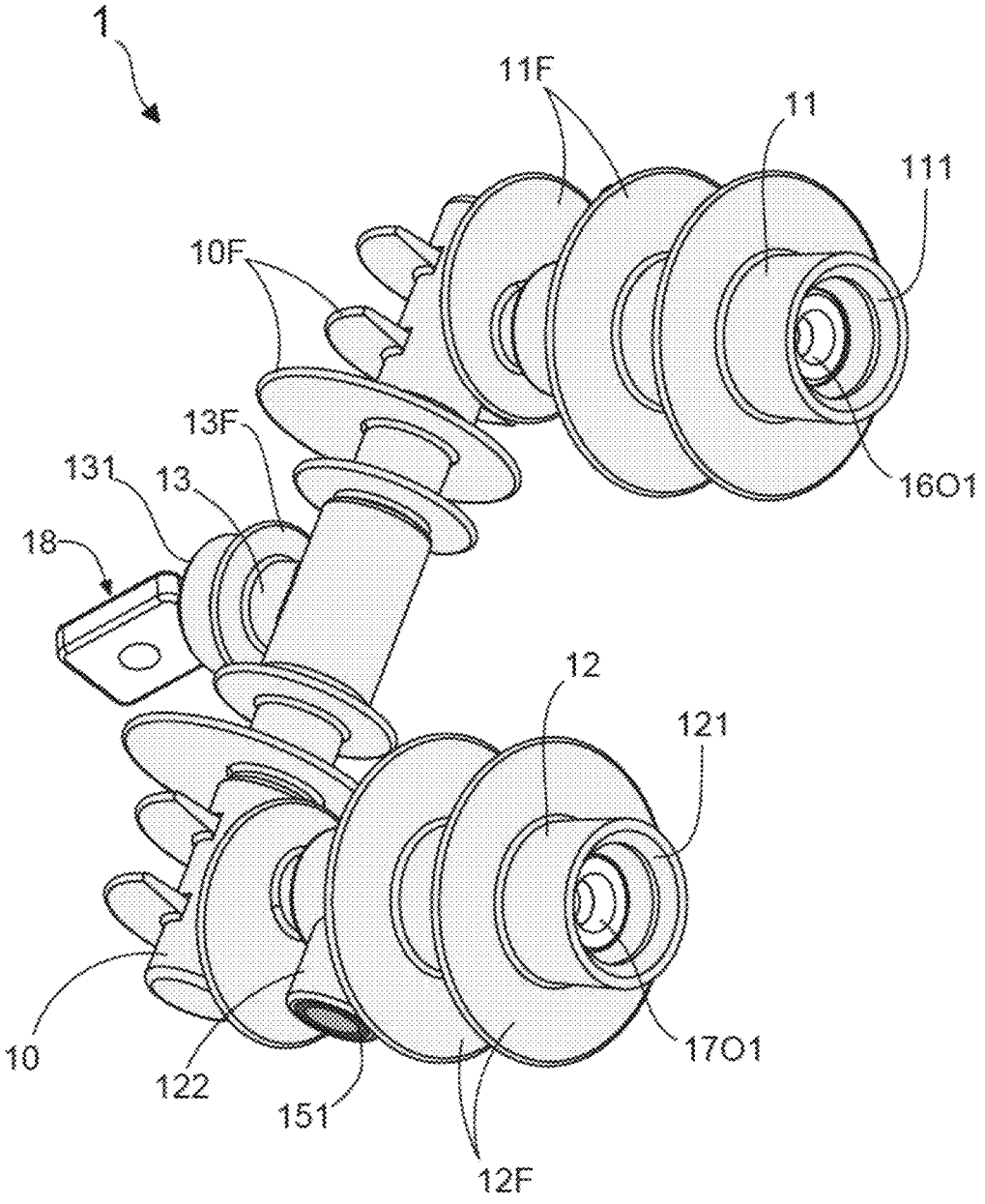
FIG. 3A shows a first stereo diagram of an insulation device according to the present invention.
Figure 3B:
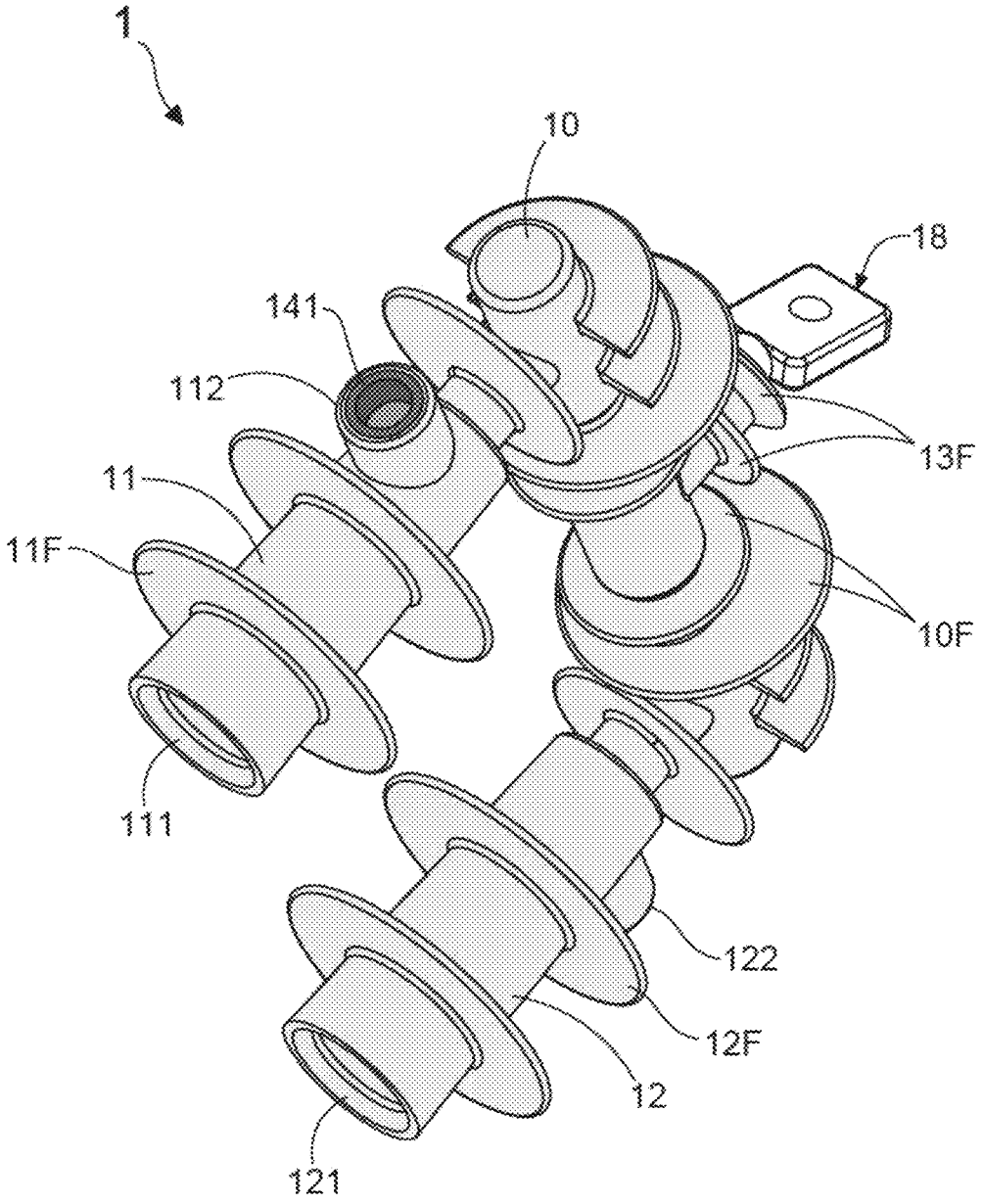
FIG. 3B shows a second stereo diagram of the insulation device according to the present invention.
Figure 4A:
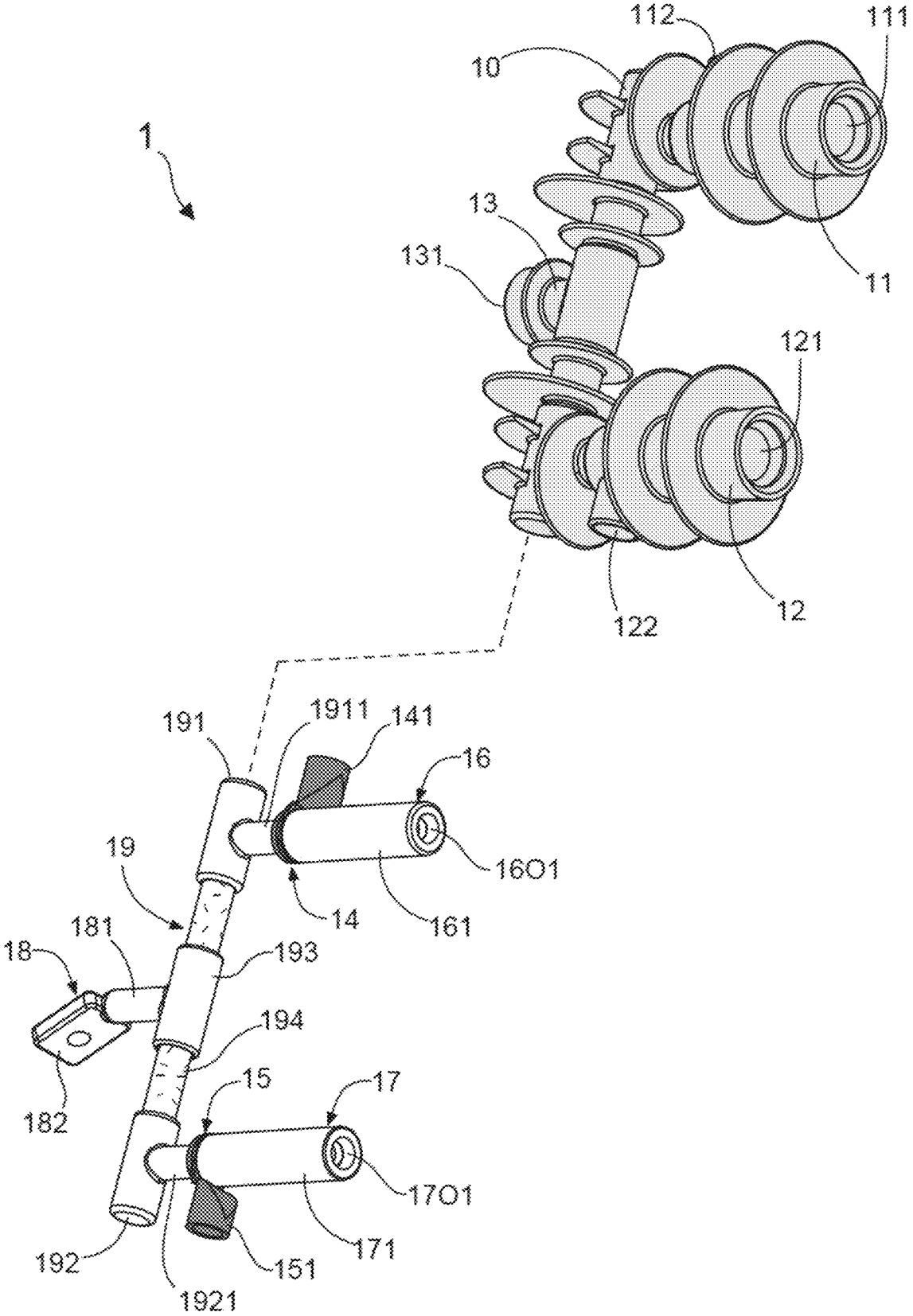
FIG. 4A shows a first explode view of the insulation device according to the present invention.
Figure 4B:
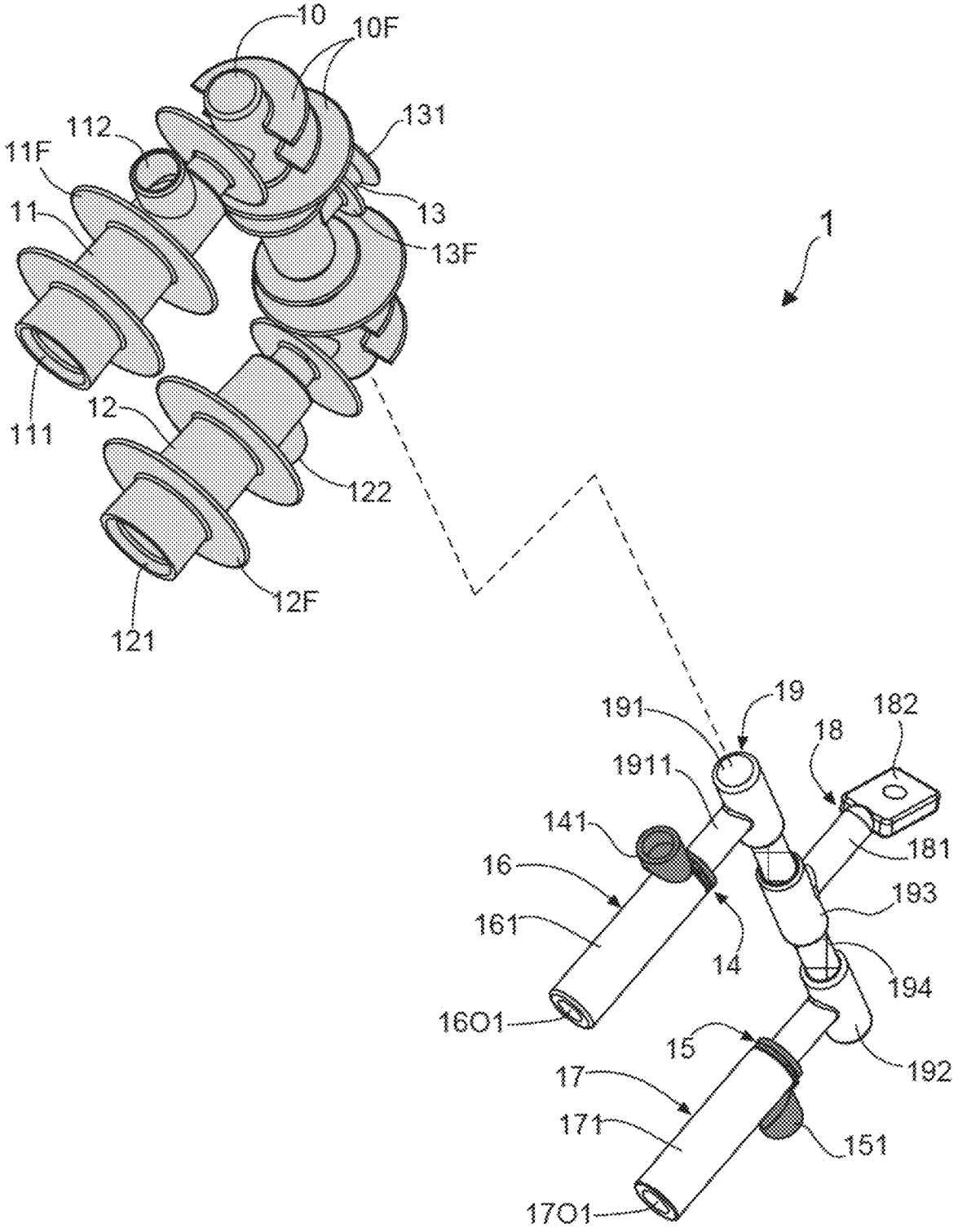
FIG. 4B shows a second explode view of the insulation device according to the present invention.

With reference to FIG. 3A and FIG. 3B, there are shown a first stereo diagram and a second stereo diagram of an insulation device according to the present invention. Moreover, FIG. 4A and FIG. 4B provide a first explode view and a second explode view of the insulation device according to the present invention. The present invention discloses an insulation device 1, which is allowed to be assembled with a fuse tube device so as to form a load break fuse cutout fully closed. According to FIG. 3A, FIG. 3B, FIG. 4A, and FIG. 4B, the insulation device 1 comprises: a full-closed cylindrical insulator 10 oriented vertically, a first cylindrical insulator 11 oriented horizontally and having a first end and a second end, a second cylindrical insulator 12 oriented horizontally and having a third end and a fourth end, a third cylindrical insulator 13 oriented horizontally and having a fifth end and a six end, a first electrical connection unit 14, a second electrical connection unit 15, a first arc extinguishing unit 16, a second arc extinguishing unit 17, a mounting bracket 18, and a structural unit 19. In which, the full-closed cylindrical insulator 10, the first cylindrical insulator 11, the second cylindrical insulator 12, and the third cylindrical insulator 13 are made integratedly so as to form a main insulation body of the insulation device. In addition, the full-closed cylindrical insulator 10 is formed with a plurality of first weathersheds 10F thereon, the first cylindrical insulator 11 is formed with a plurality of second weathersheds 11F thereon, the second cylindrical insulator 12 is formed with a plurality of third weathersheds 12F thereon, and the third cylindrical insulator 13 is formed with a plurality of fourth weathersheds 13F thereon.

As FIG. 3A, FIG. 3B, FIG. 4A, and FIG. 4B show, the first cylindrical insulator 11 is connected to the full-closed cylindrical insulator 10 by the first end thereof, and the second end has a first terminal connecting opening 111. Moreover, a first cable connection opening 112 is formed on one side of the first cylindrical insulator 11. On the other hand, the second cylindrical insulator 12 is connected to the full-closed cylindrical insulator 10 by the third end thereof, and the fourth end has a second terminal connecting opening 121. Moreover, a second cable connection opening 122 being formed on one side of the second cylindrical insulator 12. According to FIG. 3A, FIG. 3B, FIG. 4A, and FIG. 4B, it is found that the a second cylindrical insulator 12 and the first cylindrical insulator 11 have a spacing therebetween.

Figure 5:
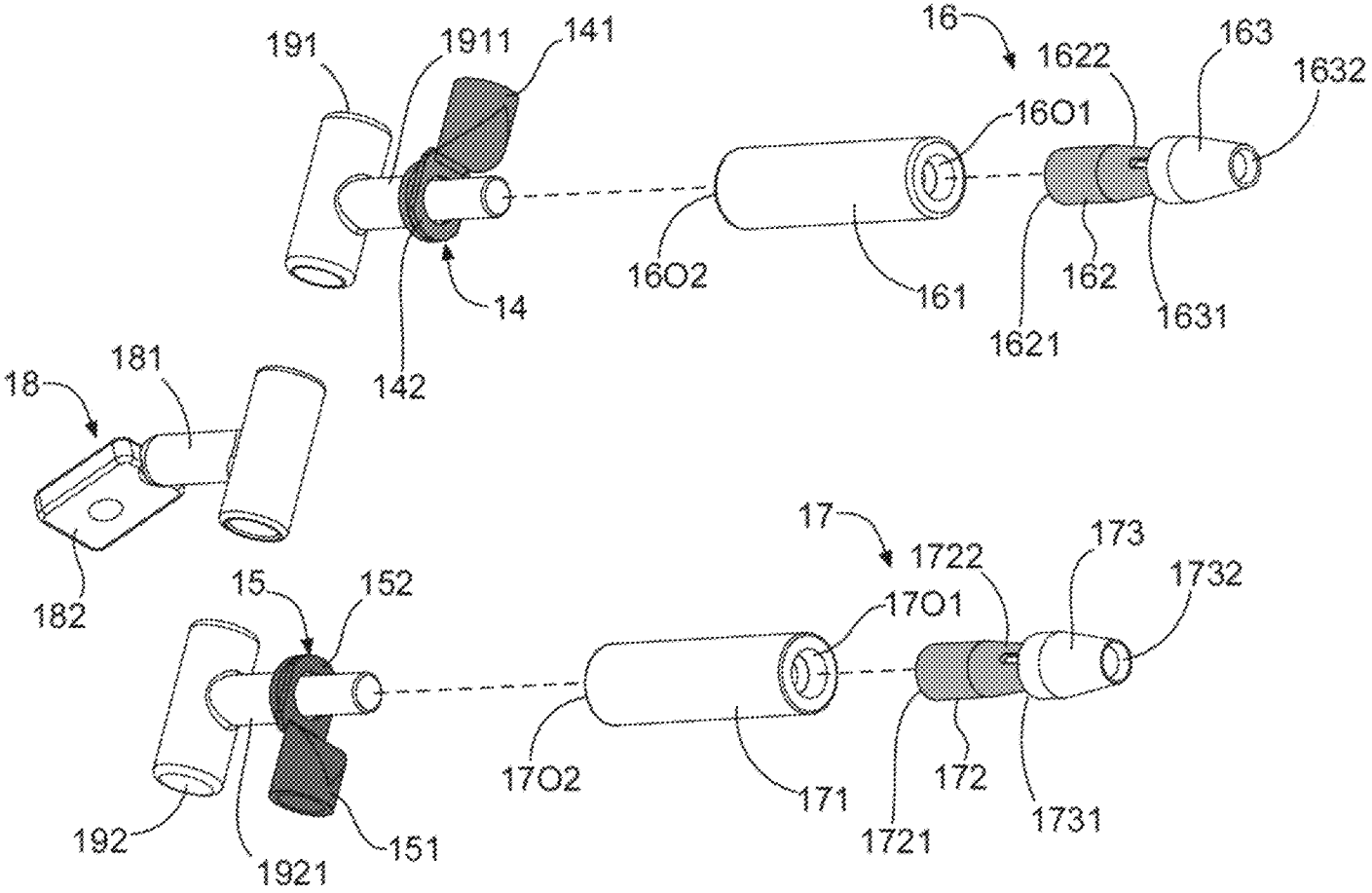
FIG. 5 shows a diagram for stereo viewing a structural unit, a mounting bracket, a first electrical connection unit, a second electrical connection unit, a first arc extinguishing unit, and a second arc extinguishing unit that are shown in FIG. 4A.

On the other hand, the third cylindrical insulator 13 is connected to the full-closed cylindrical insulator 10 by the fifth end thereof, so as to be positioned at a position on a center segment of the full-closed cylindrical insulator 10. Moreover, the sixth end of the third cylindrical insulator 13 has a first opening 131. FIG. 5 shows a diagram for stereo viewing the structural unit 19, the mounting bracket 18, the first electrical connection unit 14, the second electrical connection unit 15, the first arc extinguishing unit 16, and the second arc extinguishing unit 17 that are shown in FIG. 4A. According to FIG. 4A, FIG. 4B and FIG. 5, the first electrical connection unit 14 is accommodated in the first cylindrical insulator 11, and has a first cable connecting member 141 that is positioned in the first cable connection opening 112, such that a first electrical cable is allowed to be connected to the first cable connecting member 141 via the first cable connection opening 112. On the other hand, the second electrical connection unit 15 is accommodated in the second cylindrical insulator 12, and has a second cable connecting member 151 that is positioned in the second cable connection opening 122, such that a second electrical cable is allowed to be connected to the second cable connecting member 151 via the second cable connection opening 122.

As described in more detail below, the structural unit 19 is accommodated in the main insulation body, and comprises a first structural member 191, a second structural member 192, a third structural member 193, and a connecting member 194. According to the present invention, the first structural member 191 is disposed in the full-closed cylindrical insulator 10, and has a first part 1911 extending into the first cylindrical insulator 11. Moreover, the second structural member 192 is also disposed in the full-closed cylindrical insulator 10, and has a second part 1921 extending into the second cylindrical insulator 12. It is worth noting that, the mounting bracket 18 and the third structural member 193 are both disposed in the center segment of the full-closed cylindrical insulator 10, wherein the mounting bracket 18 comprises a supporting member 181 and a mounting member 182, and the supporting member 181 is embedded in the first opening 131 so as to be connected to the third structural member 193. Moreover, the mounting member 182 is connected with the supporting member 181, and is exposed out of the third cylindrical insulator 13, i.e., not be positioned in the center segment of the full-closed cylindrical insulator 10. As FIG. 4A, FIG. 4B and FIG. 5 show, the connecting member 194 is disposed in the full-closed cylindrical insulator 10, and is assembled with the first structural member 191, the second structural member 192 and the third structural member 193 so as to form said structural unit 19.

According to FIG. 4A, FIG. 4B and FIG. 5, the first arc extinguishing unit 16 is accommodated in the first cylindrical insulator 11, and comprises a first tube 161, a first conductive member 162 and a first arc extinguishing tube 163. According to the present invention, two ends of the first tube 161 have a second opening 1601 and a third opening 1602, respectively, and the first part 1911 of the first structural member 191 is inserted into the third opening 1602. On the other hand, the first conductive member 162 is disposed in the first tube 161, and a first top terminal of the first conductive member 162 has a first connection opening 1621 for receiving the first part 1911. In addition, a first tail terminal of the first conductive member 162 has a first claw-type opening 1622. As FIG. 4A, FIG. 4B and FIG. 5 show, the first arc extinguishing tube 163 is disposed in the first tube 161, and two ends of the first arc extinguishing tube 163 have a second connection opening 1631 and a third connection opening 1632, respectively. As described in more detail below, the second connection opening 1631 and the third connection opening 1632 communicate with a first arc extinguishing chamber in the first arc extinguishing tube 163, and the first claw-type opening 1622 is positioned in the first arc extinguishing tube 163 via the second connection opening 1631.

As described in more detail below, the first electrical connection unit 14 further has a first collar member 142 for receiving the first part 1911 of the first structural member 191. By such arrangements, the first tail terminal of the first conductive member 162 contacts the first collar member 142 of first electrical connection unit 14 in the first cylindrical insulator 11, and the first arc extinguishing tube 163 is positioned in the first terminal connecting opening 111.

According to FIG. 4A, FIG. 4B and FIG. 5, the second arc extinguishing unit 17 is accommodated in the second cylindrical insulator 12, and comprises a second tube 171, a second conductive member 172 and a second arc extinguishing tube 173. According to the present invention, two ends of the second tube 171 have a fourth opening 1701 and a fifth opening 1702, respectively, and the second part 1921 of the second structural member 192 is inserted into the fifth opening 1702. On the other hand, the second conductive member 172 is disposed in the second tube 171, and a second top terminal of the second conductive member 172 has a fourth connection opening 1721 for receiving the second part 1921. In addition, a second tail terminal of the second conductive member 172 has a second claw-type opening 1722. As FIG. 4A, FIG. 4B and FIG. 5 show, the second arc extinguishing tube 173 is disposed in the second tube 171, and two ends of the second arc extinguishing tube 173 have a fifth connection opening 1731 and a sixth connection opening 1732, respectively. As described in more detail below, the fifth connection opening 1731 and the sixth connection opening 1732 communicate with a second arc extinguishing chamber in the second arc extinguishing tube 173, and the second claw-type opening 1722 is positioned in the second arc extinguishing tube 173 via the fifth connection opening 1731.

As described in more detail below, the second electrical connection unit 15 further has a second collar member 152 for receiving the second part 1921 of the second structural member 192. By such arrangements, the second tail terminal of the second conductive member 172 contacts the second collar member 152 of the second electrical connection unit 15 in the second cylindrical insulator 12, and the second arc extinguishing tube 173 is positioned in the second terminal connecting opening 121.

According to the present invention, the first collar member 142 and the first cable connecting member 141 are made integratedly so as to form said first electrical connection unit 14. Similarly, the second collar member 152 and the second cable connecting member 151 are made integratedly so as to form said second electrical connection unit 15.

Load Break Fuse Cutout Assembly Fully Closed

Figure 6A:
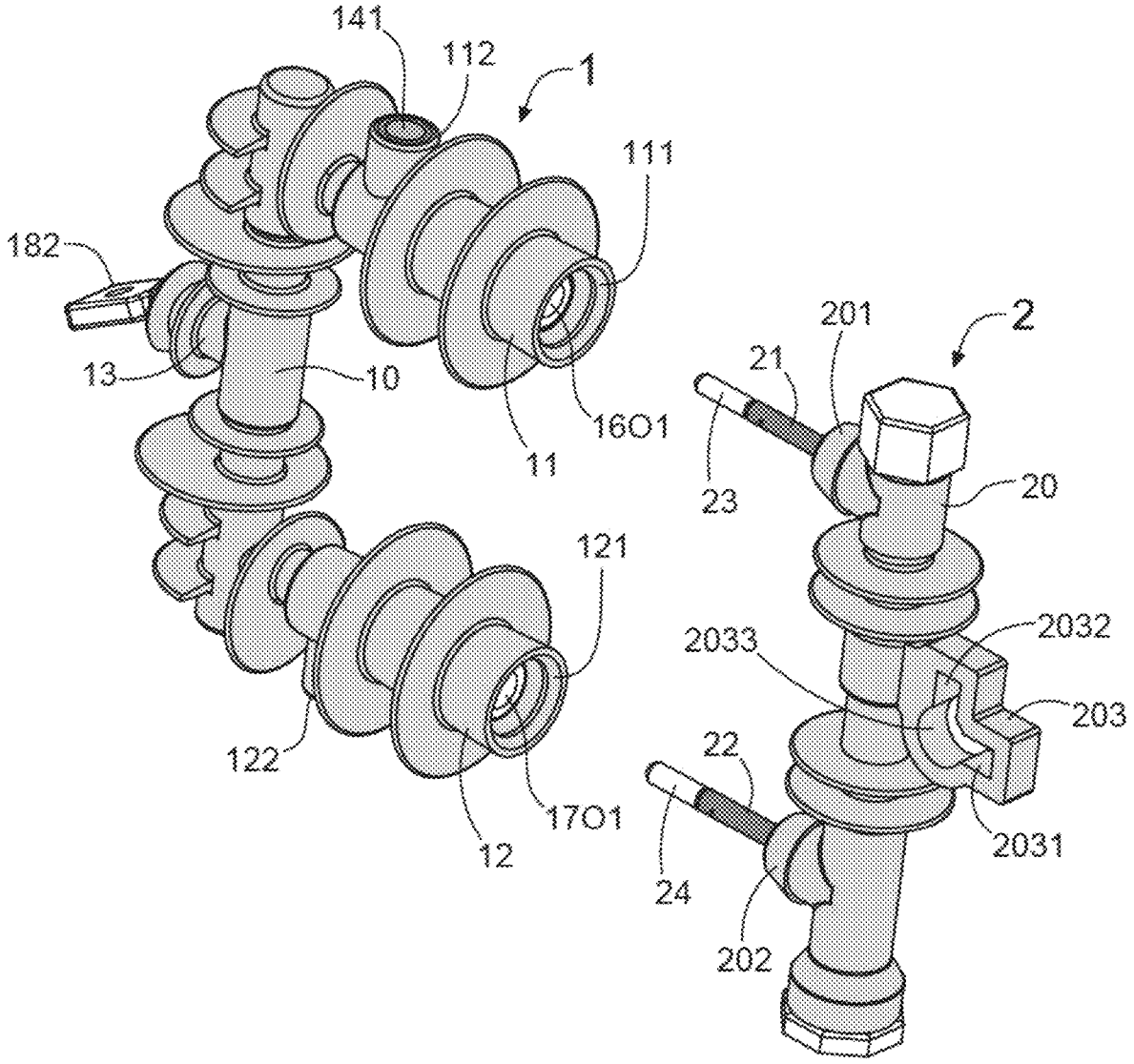
FIG. 6A shows a first stereo diagram of a load break fuse cutout fully closed according to the present invention.
Figure 6B:
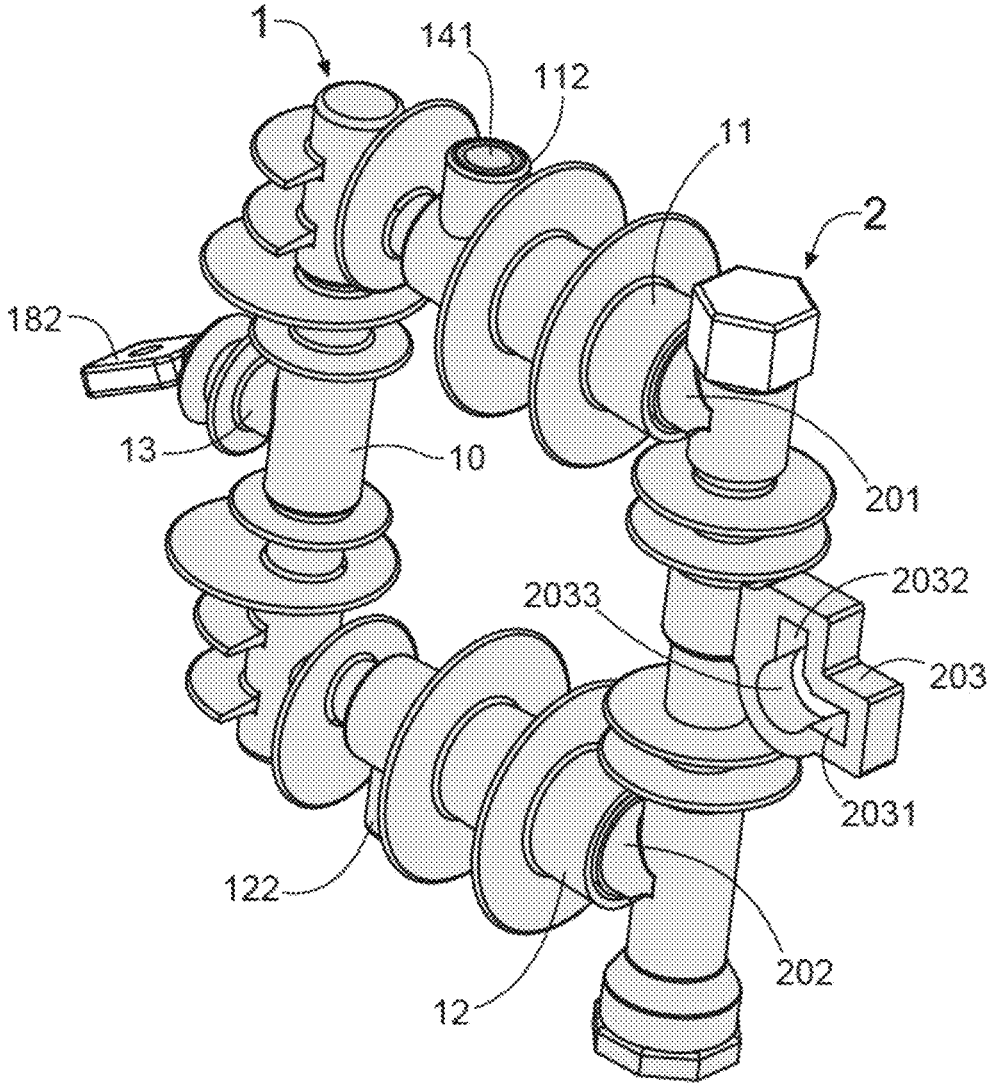
FIG. 6B shows a second stereo diagram of the load break fuse cutout fully closed according to the present invention.

With reference to FIG. 6A and FIG. 6B, there are shown a first stereo diagram and a second stereo diagram of a load break fuse cutout fully closed according to the present invention. According to FIG. 6A and FIG. 6B, the insulation device 1 is allowed to be assembled with a fuse tube device 2 so as to form a load break fuse cutout fully closed. The fuse tube device 2 comprises an insulation housing 20 and a fuse tube accommodated in the insulation housing 20. It is worth noting that, the fuse tube has a first terminal 21 and a second terminal 22 both protruding out of the insulation housing 20. In addition, a first arc extinguishing member 23 is disposed on a top of the first terminal 21, and a second arc extinguishing member 24 is disposed on a top of the second terminal 22.

As FIG. 4A, FIG. 4B, FIG. 5, and FIG. 6 show, when assembling the insulation device 1 with the fuse tube device 1, the first arc extinguishing member 23 and the first terminal 21 are inserted in to the first terminal connecting opening 111 of the first cylindrical insulator 11, such that the first terminal 21 contacts the first conductive member 162 so as to be electrically coupled to the first electrical connection unit 14 through the first conductive member 162, and the first arc extinguishing member 23 is positioned in the first arc extinguishing tube 163. Simultaneously, the second arc extinguishing member 24 and the second terminal 22 are inserted in to the second terminal connecting opening 121 of the second cylindrical insulator 12, such that the second terminal 22 contacts the second conductive member 172 so as to be electrically coupled to the second electrical connection unit 15 through the second conductive member 172, and the second arc extinguishing member 24 is positioned in the second arc extinguishing tube 173.

It is worth noting that, the insulation housing 20 has a first embedding part 201 and a second embedding part 202, the first terminal 21 protrudes out of the insulation housing 20 through the first embedding part 201, and the second terminal 22 protrudes out of the insulation housing 20 through the second embedding part 202. By such arrangements, wherein when assembling the insulation device 1 with the fuse tube device 1, the first embedding part 201 is embedded into the first terminal connecting opening 111 of the first cylindrical insulator 11, and the second embedding part 202 is embedded into the second terminal connecting opening 121 of the second cylindrical insulator 12, such that the insulation device 1 is successfully assembled with the fuse tube device 2 so as to form a load break fuse cutout fully closed.

Therefore, through above descriptions, all embodiments and their constituting elements of the insulation device and the load break fuse cutout assembly having the insulation device proposed by the present invention have been introduced completely and clearly; in summary, the present invention includes the advantages of:

(1) According to FIG. 6A and FIG. 6B show, the present invention discloses an insulation device 1, which is allowed to be assembled with a fuse tube device 2 so as to form a load break fuse cutout fully closed. Therefore, after said load break fuse cutout is applied in an electric power system for use in primary overhead feeder lines and taps to protect distribution transformers from current surges and overloads, there is no chance for birds, kites, and/or branches to cause electrocution by touching the conductive articles that are accommodated in the main insulation body of the insulation device 1 and/or the insulation housing 20 of the fuse tube device 2.

(2) According to FIG. 6A and FIG. 6B, the insulation housing 20 further has a hooking member 203 having a hooking opening that consists of a horizontal rectangular portion 2031, a vertical rectangular portion 2032 and a circular portion 2033. By such arrangements, an engineering staff is allowed to operate a live working tool to firstly connect the horizontal rectangular portion 2031, thereby pulling the fuse tube device 2 backward to make the first terminal 21 (second terminal 22) leave the first terminal connecting opening 111 (second terminal connecting opening 121). Subsequently, the engineering staff is allowed to operate the live working tool to connect the vertical rectangular portion 2032, such that the fuse tube device 2 is supported by the live working tool. Eventually, the engineering staff can operate the live working tool to move the fuse tube device 2 to the ground. In other words, it is practicable for the engineering staff staying on the ground to control the live working tool to replace the fuse tube device 2 of the load break fuse cutout 1 by a new one.

The above description is made on embodiments of the present invention. However, the embodiments are not intended to limit scope of the present invention, and all equivalent implementations or alterations within the spirit of the present invention still fall within the scope of the present invention.

What is claimed is:

1. An insulation device, comprising:

a full-closed cylindrical insulator oriented vertically;

a first cylindrical insulator oriented horizontally and having a first end and a second end, wherein the first end is connected to the full-closed cylindrical insulator, the second end having a first terminal connecting opening, and a first cable connection opening being formed on one side of the first cylindrical insulator;

a second cylindrical insulator oriented horizontally and having a third end and a fourth end, wherein the third end is connected to the full-closed cylindrical insulator, the fourth end having a second terminal connecting opening, and a second cable connection opening being formed on one side of the second cylindrical insulator;

a third cylindrical insulator oriented horizontally and having a fifth end and a six end, wherein the fifth end is connected to the full-closed cylindrical insulator so as to be positioned at a position on a center segment of the full-closed cylindrical insulator, and the sixth end having a first opening;

a first electrical connection unit, being accommodated in the first cylindrical insulator, and having a first cable connecting member that is positioned in the first cable connection opening, such that a first electrical cable is allowed to be connected to the first cable connecting member via the first cable connection opening;

a second electrical connection unit, being accommodated in the second cylindrical insulator, and having a second cable connecting member that is positioned in the second cable connection opening, such that a second electrical cable is allowed to be connected to the second cable connecting member via the second cable connection opening;

a first arc extinguishing unit, being accommodated in the first cylindrical insulator, and comprising a first arc extinguishing tube and a first conductive member having a first top terminal and a first tail terminal, wherein a portion of the first arc extinguishing tube is positioned in the first terminal connecting opening, the first top terminal being positioned in the first arc extinguishing tube, and the first tail terminal contacting the first electrical connection unit;

a second arc extinguishing unit, being accommodated in the second cylindrical insulator, and comprising a second arc extinguishing tube and a second conductive member having a second top terminal and a second tail terminal, wherein a portion of the second arc extinguishing tube is positioned in the second terminal connecting opening, the second top terminal being positioned in the second arc extinguishing tube, and the second tail terminal contacting the second electrical connection unit; and a mounting bracket, comprising a supporting member and a mounting member, wherein the supporting member is embedded in the first opening, and the mounting member being connected with the supporting member and exposed out of the third cylindrical insulator.

2. The insulation device of claim 1, wherein the full-closed cylindrical insulator, the first cylindrical insulator, the second cylindrical insulator, and the third cylindrical insulator are made integratedly so as to form a main insulation body of the insulation device.

3. The insulation device of claim 1, wherein the full-closed cylindrical insulator is formed with a plurality of first weathersheds thereon, the first cylindrical insulator being formed with a plurality of second weathersheds thereon, the second cylindrical insulator being formed with a plurality of third weathersheds thereon, and the third cylindrical insulator being formed with a plurality of fourth weathersheds thereon.

4. The insulation device of claim 2, further comprising a structural unit accommodated in the main insulation body, wherein the structural unit comprises:

a first structural member, being disposed in the full-closed cylindrical insulator, and having a first part extending into the first cylindrical insulator;

a second structural member, being disposed in the full-closed cylindrical insulator, and having a second part extending into the second cylindrical insulator;

a third structural member, being disposed in the center segment of the full-closed cylindrical insulator, and being connected with the supporting member of the mounting bracket; and a connecting member, being disposed in the full-closed cylindrical insulator, and being assembled with the first structural member, the second structural member and the third structural member so as to form said structural unit.

5. The insulation device of claim 4, wherein the first arc extinguishing unit further comprises a first tube, wherein two ends of the first tube have a second opening and a third opening, respectively, and the first part of the first structural member being positioned in the third opening;

wherein the first conductive member is disposed in the first tube, and the first top terminal of the first conductive member having a first connection opening for receiving the first part, and the first tail terminal of the first conductive member having a first claw-type opening;

wherein the first arc extinguishing tube is disposed in the first tube, and two ends of the first arc extinguishing tube having a second connection opening and a third connection opening, respectively; and wherein the second connection opening and the third connection opening communicate with a first arc extinguishing chamber in the first arc extinguishing tube, and the first claw-type opening being positioned in the first arc extinguishing tube via the second connection opening.

6. The insulation device of claim 5, wherein the second arc extinguishing unit further comprises a second tube, wherein two ends of the second tube have a fourth opening and a fifth opening, respectively, and the second part of the second structural member being positioned in the fifth opening;

wherein the second conductive member is disposed in the second tube, and the second top terminal of the second conductive member having a fourth connection opening for receiving the second part, and the second tail terminal of the second conductive member having a second claw-type opening;

wherein the second arc extinguishing tube is disposed in the second tube, and two ends of the second arc extinguishing tube having a fifth connection opening and a sixth connection opening, respectively; and wherein the fifth connection opening and the sixth connection opening communicate with a second arc extinguishing chamber in the second arc extinguishing tube, and the second claw-type opening being positioned in the second arc extinguishing tube via the fifth connection opening.

7. The insulation device of claim 6, wherein the first electrical connection unit further has a first collar member for receiving the first part of the first structural member.

8. The insulation device of claim 7, wherein the second electrical connection unit further has a second collar member for receiving the second part of the second structural member.

9. The insulation device of claim 7, wherein the first collar member and the first cable connecting member are made integratedly so as to form said first electrical connection unit.

10. The insulation device of claim 8, wherein the second collar member and the second cable connecting member are made integratedly so as to form said second electrical connection unit.

11. A load break fuse cutout assembly, comprising:

a fuse tube device, comprising an insulation housing and a fuse tube accommodated in the insulation housing; wherein the fuse tube has a first terminal and a second terminal both protruding out of the insulation housing, a first arc extinguishing member being disposed on a top of the first terminal, and a second arc extinguishing member being disposed on a top of the second terminal; and an insulation device, comprising:

a full-closed cylindrical insulator oriented vertically;

a first cylindrical insulator oriented horizontally and having a first end and a second end, wherein the first end is connected to the full-closed cylindrical insulator, the second end having a first terminal connecting opening, and a first cable connection opening being formed on one side of the first cylindrical insulator;

a second cylindrical insulator oriented horizontally and having a third end and a fourth end, wherein the third end is connected to the full-closed cylindrical insulator, the fourth end having a second terminal connecting opening, and a second cable connection opening being formed on one side of the second cylindrical insulator;

a third cylindrical insulator oriented horizontally and having a fifth end and a six end, wherein the fifth end is connected to the full-closed cylindrical insulator so as to be positioned at a position on a center segment of the full-closed cylindrical insulator, and the sixth end having a first opening;

a first electrical connection unit, being accommodated in the first cylindrical insulator, and having a first cable connecting member that is positioned in the first cable connection opening, such that a first electrical cable is allowed to be connected to the first cable connecting member via the first cable connection opening;

a second electrical connection unit, being accommodated in the second cylindrical insulator, and having a second cable connecting member that is positioned in the second cable connection opening, such that a second electrical cable is allowed to be connected to the second cable connecting member via the second cable connection opening;

a first arc extinguishing unit, being accommodated in the first cylindrical insulator, and comprising a first arc extinguishing tube and a first conductive member having a first top terminal and a first tail terminal, wherein a portion of the first arc extinguishing tube is positioned in the first terminal connecting opening, the first top terminal being positioned in the first arc extinguishing tube, and the first tail terminal contacting the first electrical connection unit;

a second arc extinguishing unit, being accommodated in the second cylindrical insulator, and comprising a second arc extinguishing tube and a second conductive member having a second top terminal and a second tail terminal, wherein a portion of the second arc extinguishing tube is positioned in the second terminal connecting opening, the second top terminal being positioned in the second arc extinguishing tube, and the second tail terminal contacting the second electrical connection unit; and a mounting bracket, comprising a supporting member and a mounting member, wherein the supporting member is embedded in the first opening, and the mounting member being connected with the supporting member and exposed out of the third cylindrical insulator;

wherein when assembling the insulation device with the fuse tube device, the first arc extinguishing member and the first terminal being inserted in to the first terminal connecting opening of the first cylindrical insulator, such that the first terminal contacts the first conductive member so as to be electrically coupled to the first electrical connection unit through the first conductive member, and the first arc extinguishing member being positioned in the first arc extinguishing tube;

wherein when assembling the insulation device with the fuse tube device, the second arc extinguishing member and the second terminal being inserted in to the second terminal connecting opening of the second cylindrical insulator, such that the second terminal contacts the second conductive member so as to be electrically coupled to the second electrical connection unit through the second conductive member, and the second arc extinguishing member being positioned in the second arc extinguishing tube.

12. The load break fuse cutout assembly of claim 11, wherein the full-closed cylindrical insulator, the first cylindrical insulator, the second cylindrical insulator, and the third cylindrical insulator are made integratedly so as to form a main insulation body of the insulation device.

13. The load break fuse cutout assembly of claim 11, wherein the full-closed cylindrical insulator is formed with a plurality of first weathersheds thereon, the first cylindrical insulator being formed with a plurality of second weathersheds thereon, the second cylindrical insulator being formed with a plurality of third weathersheds thereon, and the third cylindrical insulator being formed with a plurality of fourth weathersheds thereon.

14. The load break fuse cutout assembly of claim 12, further comprising a structural unit accommodated in the main insulation body, wherein the structural unit comprises:

a first structural member, being disposed in the full-closed cylindrical insulator, and having a first part extending into the first cylindrical insulator;

a second structural member, being disposed in the full-closed cylindrical insulator, and having a second part extending into the second cylindrical insulator;

a third structural member, being disposed in the center segment of the full-closed cylindrical insulator, and being connected with the supporting member of the mounting bracket; and a connecting member, being disposed in the full-closed cylindrical insulator, and being assembled with the first structural member, the second structural member and the third structural member so as to form said structural unit.

15. The load break fuse cutout assembly of claim 14, wherein the first arc extinguishing unit further comprises a first tube, wherein two ends of the first tube have a second opening and a third opening, respectively, and the first part of the first structural member being positioned in the third opening;

wherein the first conductive member is disposed in the first tube, and the first top terminal of the first conductive member having a first connection opening for receiving the first part, and the first tail terminal of the first conductive member having a first claw-type opening;

wherein the first arc extinguishing tube is disposed in the first tube, and two ends of the first arc extinguishing tube having a second connection opening and a third connection opening, respectively; and wherein the second connection opening and the third connection opening communicate with a first arc extinguishing chamber in the first arc extinguishing tube, and the first claw-type opening being positioned in the first arc extinguishing tube via the second connection opening.

16. The load break fuse cutout assembly of claim 15, wherein the second arc extinguishing unit further comprises a second tube, wherein two ends of the second tube have a fourth opening and a fifth opening, respectively, and the second part of the second structural member being positioned in the fifth opening;

wherein the second conductive member is disposed in the second tube, and the second top terminal of the second conductive member having a fourth connection opening for receiving the second part, and the second tail terminal of the second conductive member having a second claw-type opening;

wherein the second arc extinguishing tube is disposed in the second tube, and two ends of the second arc extinguishing tube having a fifth connection opening and a sixth connection opening; and wherein the fifth connection opening and the sixth connection opening communicate with a second arc extinguishing chamber in the second arc extinguishing tube, and the second claw-type opening being positioned in the second arc extinguishing tube via the fifth connection opening.

17. The load break fuse cutout assembly of claim 16, wherein the first electrical connection unit further has a first collar member for receiving the first part of the first structural member.

18. The load break fuse cutout assembly of claim 17, wherein the second electrical connection unit further has a second collar member for receiving the second part of the second structural member.

19. The load break fuse cutout assembly of claim 17, wherein the first collar member and the first cable connecting member are made integratedly so as to form said first electrical connection unit.

20. The load break fuse cutout assembly of claim 18, wherein the second collar member and the second cable connecting member are made integratedly so as to form said second electrical connection unit.

* * * * *